US008475045B2

(12) United States Patent
Meyer et al.

(10) Patent No.: US 8,475,045 B2
(45) Date of Patent: Jul. 2, 2013

(54) BAG WITH COVER

(75) Inventors: Michael J. Meyer, Baltimore, MD (US); Edward G. Russell, Baltimore, MD (US); Stephen Cleary, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 256 days.

(21) Appl. No.: 12/944,944

(22) Filed: Nov. 12, 2010

(65) Prior Publication Data

US 2012/0121210 A1 May 17, 2012

(51) Int. Cl.

| | |
|---|---|
| ***B65D 30/22*** | (2006.01) |
| ***B65D 33/06*** | (2006.01) |
| ***A45C 3/08*** | (2006.01) |
| ***A45C 1/02*** | (2006.01) |
| ***A45C 3/00*** | (2006.01) |

(52) U.S. Cl.

USPC ..... 383/40; 383/13; 150/105; 150/112; 190/109

(58) Field of Classification Search

USPC ..... 383/4, 13, 40, 111; 150/105, 107, 150/117, 112; 190/109, 111, 26

See application file for complete search history.

(56) References Cited

U.S. PATENT DOCUMENTS

| | | | | | |
|---|---|---|---|---|---|
| 2,432,365 | A | * | 12/1947 | Allen | 190/115 |
| 3,977,451 | A | | 8/1976 | Duba | |
| 3,998,304 | A | | 12/1976 | Copeland | |
| 4,026,339 | A | * | 5/1977 | Burke | 150/110 |
| D256,293 | S | | 8/1980 | Edwards | |
| 4,474,388 | A | | 10/1984 | Wagner | |
| 4,498,579 | A | | 2/1985 | Brick | |
| 4,657,135 | A | * | 4/1987 | Kjose | 206/315.3 |
| 4,699,164 | A | | 10/1987 | Pilney | |
| 4,953,674 | A | * | 9/1990 | Landes | 190/108 |
| 4,953,768 | A | | 9/1990 | Muse | |
| 5,005,623 | A | | 4/1991 | Webster | |
| 5,131,442 | A | | 7/1992 | Bevier | |
| 5,154,332 | A | * | 10/1992 | Williams et al. | 224/153 |
| 5,407,112 | A | | 4/1995 | Christodoulou | |
| 5,439,153 | A | * | 8/1995 | Murdoch et al. | 224/658 |
| 5,452,476 | A | | 9/1995 | Jenks | |
| 5,507,332 | A | | 4/1996 | McKinnon | |
| 5,526,969 | A | | 6/1996 | Greenberger | |
| 5,564,125 | A | | 10/1996 | Waldman | |
| 5,690,155 | A | | 11/1997 | Millar | |

(Continued)

FOREIGN PATENT DOCUMENTS

| | | | |
|---|---|---|---|
| CN | 2879771 | Y | 3/2007 |
| FR | 2721183 | A | 12/1995 |

(Continued)

*Primary Examiner* — Jes F Pascua

(74) *Attorney, Agent, or Firm* — Maginot, Moore & Beck LLP

(57) ABSTRACT

A bag includes an outer body portion or outer shell which encloses a storage compartment. The bag also includes a pocket non-removably attached to the bag which is accessible through the outer body portion or outer shell and is freely contained within the storage compartment. The pocket is configured to retain a cover, which is non-removably attached thereto. The cover is a flexible material that is water resistant or water repellant. The cover can be collapsed and stored within the pocket or can be withdrawn from the pocket and spread over the outer body portion or outer shell of the bag, thereby protecting it, for example, from inclement weather.

20 Claims, 8 Drawing Sheets

U.S. PATENT DOCUMENTS

| | | | | |
|---|---|---|---|---|
| 6,024,264 | A | 2/2000 | Java | |
| 6,279,796 | B1 * | 8/2001 | Trevino | 224/153 |
| 6,283,290 | B1 | 9/2001 | Thompson | |
| 6,422,444 | B1 | 7/2002 | Richardson | |
| 6,543,658 | B2 * | 4/2003 | Trevino | 224/153 |
| 6,637,562 | B2 * | 10/2003 | Oh | 190/26 |
| 7,093,699 | B2 * | 8/2006 | Yu | 190/26 |
| 7,441,641 | B2 * | 10/2008 | Beakey | 190/26 |
| 7,458,452 | B2 * | 12/2008 | Beakey | 190/26 |
| 8,152,374 | B2 * | 4/2012 | Shaul | 383/37 |
| 2003/0033658 | A1 | 2/2003 | Hinnant | |
| 2003/0205593 | A1 | 11/2003 | Lavelle | |
| 2005/0095103 | A1 | 5/2005 | Fisher | |
| 2005/0161482 | A1 | 7/2005 | Krohn | |
| 2006/0231434 | A1 | 10/2006 | Krippner | |
| 2007/0017764 | A1 * | 1/2007 | Cheng et al. | 190/100 |
| 2007/0284022 | A1 | 12/2007 | Hall | |
| 2008/0040837 | A1 | 2/2008 | Beaton | |
| 2008/0047859 | A1 | 2/2008 | Beene | |
| 2008/0169322 | A1 | 7/2008 | McMillan | |
| 2010/0078457 | A1 | 4/2010 | Whitney | |
| 2010/0270115 | A1 * | 10/2010 | Seamon | 190/26 |

FOREIGN PATENT DOCUMENTS

| | | | |
|---|---|---|---|
| GB | 2471916 | A | 1/2011 |
| JP | 20021165638 | A | 6/2002 |
| WO | 8606939 | A | 12/1986 |
| WO | 2008051213 | A | 5/2008 |

* cited by examiner

BAG WITH COVER

FIELD

This application relates to the field of covers for bags and particularly to covers for duffel bags, gym bags, equipment bags and other bags that may be used to carry and/or store items.

BACKGROUND

Various bags may be used to store and carry sporting or other equipment to and from various locations. In some cases, such as sporting events, a participant may leave a bag unattended for an extended period of time. If the bag must be left outdoors during inclement weather, any items in the bag will be at risk of suffering damage due to precipitation. This is true even if the bag is relatively water resistant, as precipitation may still enter the bag through seams, zippers and other more porous surfaces.

To keep articles in a bag dry while the bag is forced to endure inclement weather, it would be advantageous for the bag to include some type of protective feature to keep liquid out. It would be advantageous if such a protective feature was incorporated in the bag and could easily transition between a stored position and an in-use position. Furthermore, it would be advantageous if such protective feature could be easily stored away so that it would not interfere with use of the bag when the protective feature was not needed to keep out precipitation. Additionally, it would be advantageous if such protective feature could be used for weather protection while still allowing the bag to be easily transported.

SUMMARY

In accordance with one embodiment of the disclosure, there is provided a bag comprising a body portion which contains a storage compartment. The bag also includes a cover carried by the body portion, with at least one opening provided in the cover. The cover is configured to be arranged in either a collapsed position, where the cover is situated within the body portion, or a protective position, where the cover is situated so that it surrounds the body portion. The bag also includes a strap coupling that is connected to the body portion and is configured to extend through the opening in the cover. The bag also includes a strap releaseably coupled to the strap coupling. Various embodiments of the bag and cover are possible. For example, the strap included in the bag may be a shoulder strap. In at least one embodiment, the strap is releaseably coupled to the coupling member with a hook. The bag may further comprise a pocket positioned within the body portion. This pocket may be configured to retain the cover when the cover is in the collapsed position. In at least one other alternative embodiment, the cover may be non-releasably connected to the pocket. The cover may be comprised of a water-resistant or water-repellant material.

In accordance with another embodiment of the disclosure, there is provided a bag comprising an outer shell which contains a storage compartment. The bag also includes a carrying member including at least one strap and a coupling member configured to couple the strap to the outer shell. The bag also includes a pocket within the storage compartment. Access to the storage compartment is provided through the outer shell. The bag also includes a cover positioned within the pocket. The cover is designed and dimensioned to cover the outer shell and the cover includes an opening which is configured so that the carrying member may pass through the opening from the outer shell to a position outside the cover.

In accordance with another embodiment of the disclosure, the cover may include a first opening on one side of the cover and a second opening on the opposite side of the cover. In accordance with another embodiment, the coupling member may extend through the opening when the cover is placed over the bag. In yet another embodiment, the cover may include an elastic member along a perimeter portion of the cover.

Use of one or more embodiments of the bag disclosed herein results in a method for using a bag in various weather conditions. The method includes removing a flexible cover from a pocket of the bag and placing the flexible cover in a protective position over the bag. The method further includes inserting at least one coupling member through an opening in the flexible cover and connecting a carrying member to the coupling member in order to attach the carrying member to the bag. In at least one embodiment, the flexible cover remains attached to the pocket when the flexible cover is removed from the pocket. Following transport of the bag with the carrying member, the method may further include removing the carrying member from the coupling member, removing the cover from the protective position over the bag, and re-inserting the cover into the pocket of the bag.

The above described features and advantages, as well as others, will become more readily apparent to those of ordinary skill in the art by reference to the following detailed description and accompanying drawings. While it would be desirable to provide a bag that includes one or more of these or other advantageous features, the teachings disclosed herein extend to those embodiments which fall within the scope of the appended claims, regardless of whether they accomplish one or more of the above-mentioned advantages.

DESCRIPTION

Figure 1:
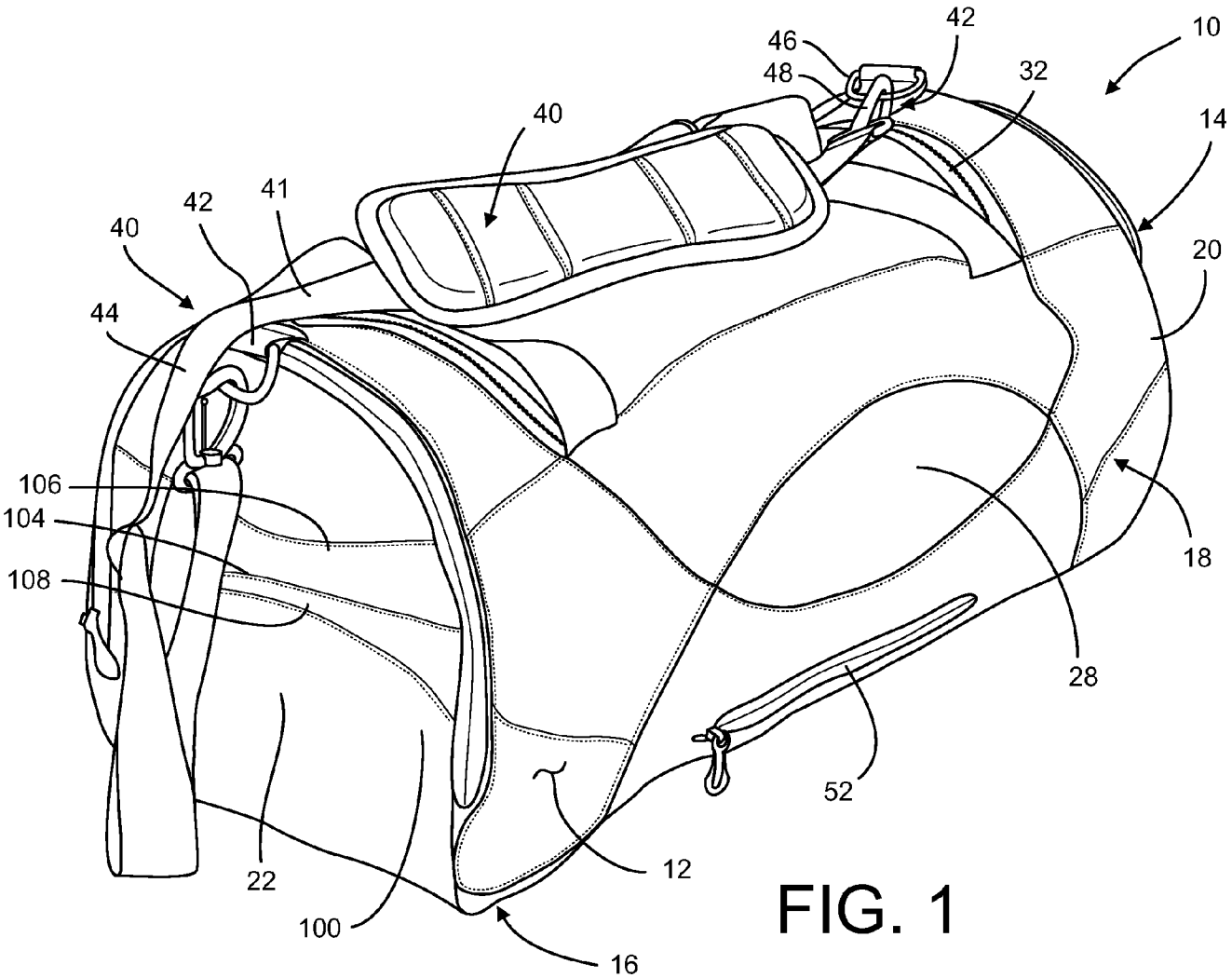
FIG. 1 shows a perspective view of a bag.
Figure 2:
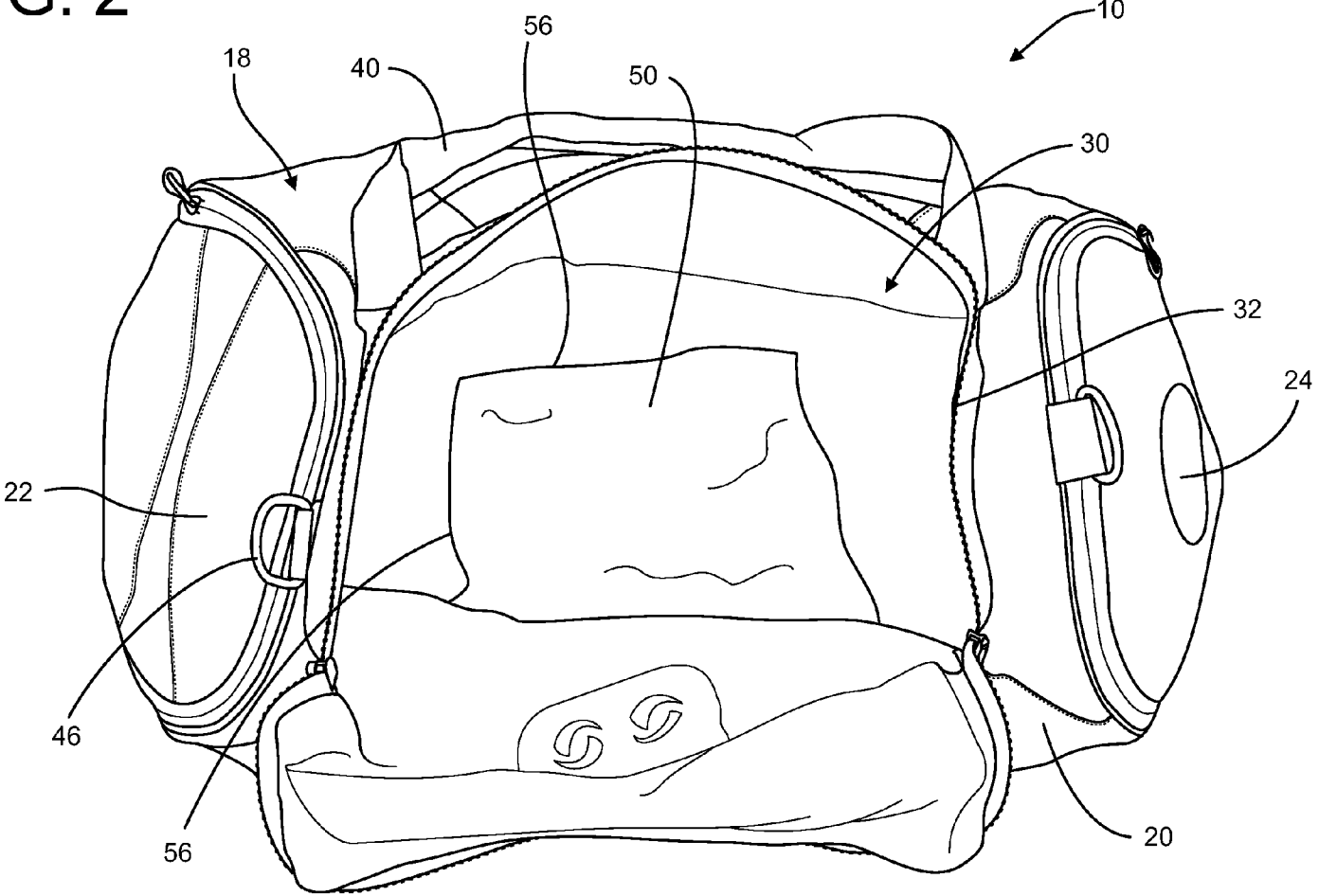
FIG. 2 shows a top view of the bag of FIG. 1 with a bag closure in an open position disclosing the storage compartment contained within the body portion.

Referring generally to FIGS. 1 and 2, a bag 10 is shown. The bag 10 includes a body portion 18 including an outer shell 20 which encloses a storage compartment 30. The bag 10 includes a carrying arrangement 40 which may include a handle or a strap. The bag 10 also includes a pocket 50 which is accessed through a pocket opening 52 in the outer shell 20 (shown in FIG. 1) and is contained within the storage compartment 30 (shown in FIG. 2). The pocket 50 opens to provide access to a cover 60 (shown in FIG. 5) which is used to extend over the outer shell 20 of the bag 10 to shield it, for example, from inclement weather. The cover 60 is non-removably attached to the pocket 50 and may be stored within the pocket 50 when not in use. In the disclosed embodiment, the bag 10 is a gym bag or duffel bag. However, it will be understood that, in an alternative embodiment, the bag 10 could be any of various other types of bags used for portage and storage. For example, the bag may be an equipment bag, a ball bag, a backpack, a briefcase, a suitcase, or any of various other types of bags.

The outer shell 20 of the bag 10 is generally comprised of a flexible material 12. In at least one embodiment, the flexible material 12 may be a textile material, such as, for example, a knit, woven, or non-woven fabric. In other embodiments, the flexible material 12 may be a leather material or synthetic material. Moreover, although the outer shell 20 of the bag 10 is disclosed herein as being made of a flexible material 12, it will be recognized that in at least one alternative embodiment, the outer shell 20 may be comprised of a relatively hard and inflexible material, such as a leather covered plastic.

Figure 3:
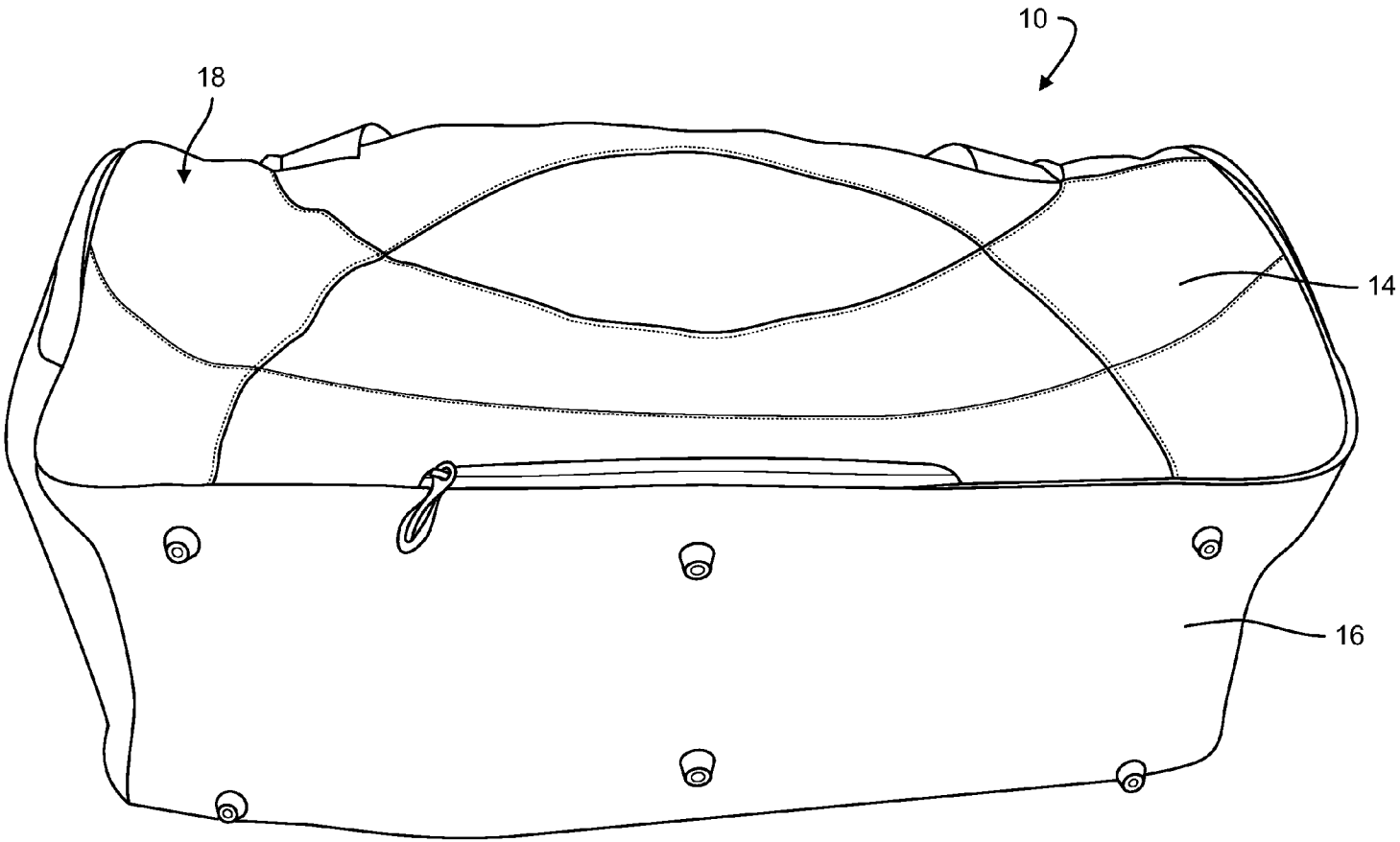
FIG. 3 shows a bottom perspective view of the bag of FIG. 1 and shows an upper portion and a base portion of the bag, with a pocket near the base portion of the bag.

As shown in FIGS. 1 and 3, the outer shell 20 of the bag 10 includes a body portion 18 which defines an upper portion 14 and a base portion 16. The upper portion 14 defines a first side 22, a second side 24 (best shown in FIG. 2), a front side (not shown) and a back side 28 of the bag. One or more panels may be connected to form the various sides of the bag 10. For example, various panels may be sewn and/or adhered together along seams to form the various sides of the bag 10.

Referring now to FIG. 2, the outer shell 20 of the bag 10 encloses a storage compartment 30 provided within the bag. The outer shell 20 further includes a storage compartment closure 32 which may be opened to provide access to the storage compartment 30. In particular, when the storage compartment closure 32 is in an open position, as shown in FIG. 2, a user may access the storage compartment 30. However, when the storage compartment closure 32 is in a closed position, as shown in FIG. 1, access to the storage compartment 30 is blocked. The storage compartment closure 32 may be a zipper or any other appropriate closure means known in the art. In the embodiment of FIGS. 1 and 2, the storage compartment closure 32 is provided on the upper portion 14 of the bag 10 and extends along the outer shell 20 from a position proximate to the first side 22 to a position proximate to the second side 24.

With particular reference to FIG. 1, the bag 10 further includes a carrying arrangement 40. The carrying arrangement 40 includes at least one carrying member 41 and a coupling member 42 connected to the outer shell 20. In the disclosed embodiment, the carrying member 41 is a flexible strap 44 in the form of a shoulder strap. In at least one alternative embodiment, the flexible strap 44 may be in the form of a handle. While only one flexible strap 44 has been disclosed herein, it will be recognized that the bag 10 may include more than one carrying member 41. For example, the bag 10 may include both a shoulder strap and a handle. Moreover, although a flexible strap 44 has been disclosed herein as the carrying member 41, in at least one alternative embodiment, the carrying member 41 may be a relatively rigid and non-flexible member.

The carrying member 41 is removably attached to the bag 10 with the coupling member 42. In the disclosed embodiment, the coupling member 42 is a strap coupling that is non-removably attached to the outer shell 20 of the bag 10. The strap coupling includes at least one loop 46 that is connected to the outer shell 20 of the bag 10 and a hook 48 that is connected to the flexible strap 44. The loop 46 is non-removably attached to the upper portion 14 of the bag 10 and may include one or more fabric loops or plastic loops. The hook 48 is configured to releasably engage the loop 46, thus allowing the user to release the flexible strap 44 from the bag 10 or couple the strap to the bag 10. It will be recognized that the coupling member 42 may be configured differently in various alternative embodiments. For example, the hook 48 of the coupling member 42 may be connected to the outer shell 20 instead of the flexible strap 44, or the coupling member 42 may include an arrangement that does not utilize a hook to couple the strap 44 to the bag 10. Moreover, in at least one alternative embodiment the coupling member 42 may take the form of sewing, adhesive or other fastening means to attach the strap directly to another portion of the bag 10.

Figure 4:
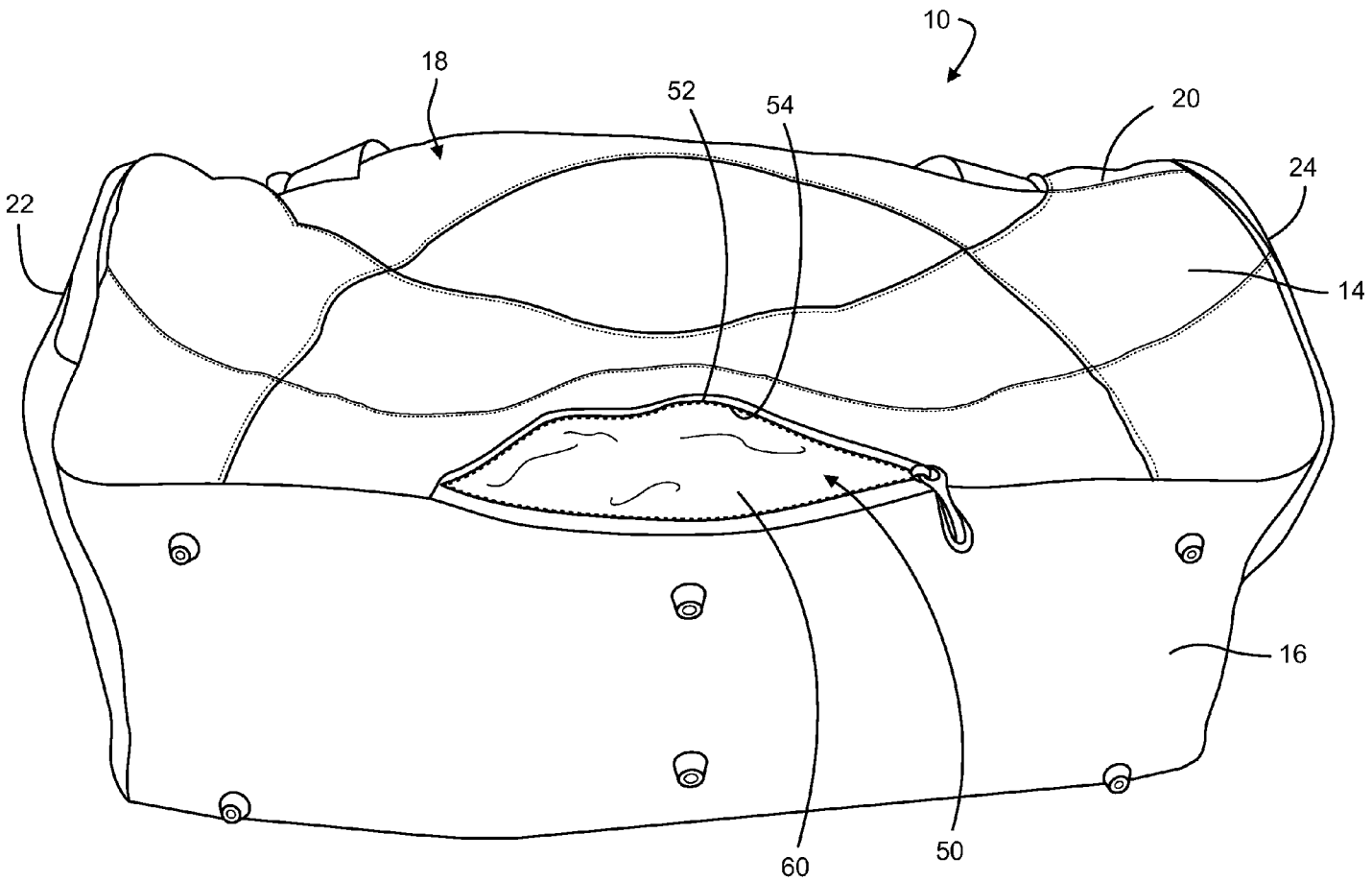
FIG. 4 shows a bottom perspective view of the bag of FIG. 1 with the pocket in an open position and a cover in a collapsed position within the pocket.

As best shown in FIGS. 2 and 4, the bag 10 further includes a pocket 50 that is retained within the storage compartment 30. A pocket opening 52 that leads to the pocket 50 is provided on the outer shell 20. A zipper provides a closure for the pocket opening 52. As shown in FIG. 4, the pocket opening 52 is provided near the base portion 16 of the body portion 18 of the bag 10. The pocket opening 52 extends along the outer shell 20 from a position proximate the first side 22 to a position proximate the second side 24. The pocket 50 includes at least one attached edge 54 which is non-removably attached to the bag 10 along the pocket opening 52. Additionally, the pocket 50 includes a free edge 56 (shown in FIG. 2) which is loosely retained within the storage compartment 30.

Figure 5:
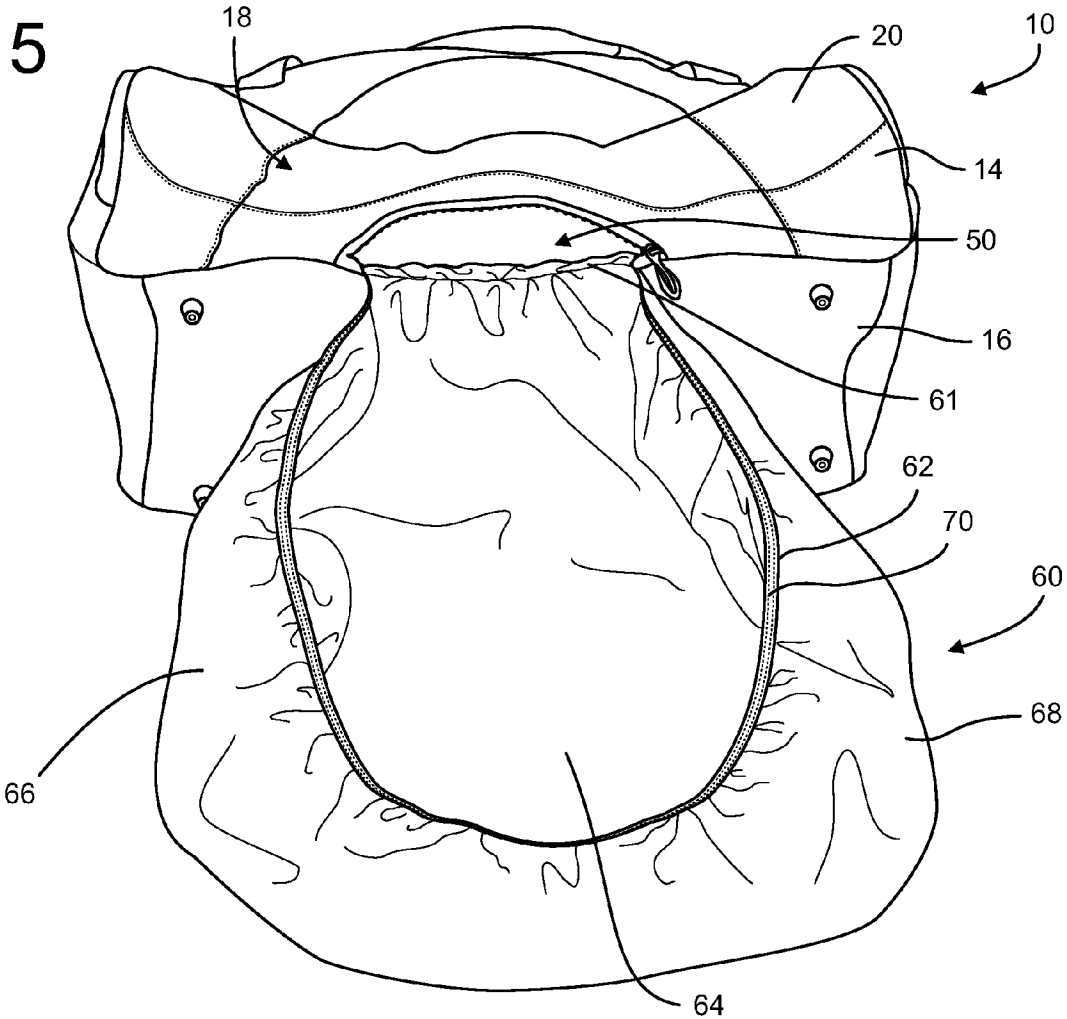
FIG. 5 shows a bottom perspective view of the bag of FIG. 1 with the cover extending out of the pocket.

Referring now to FIG. 5, the bag 10 includes a cover 60 that can be retained within the pocket 50. The cover 60 is made of a flexible material and is collapsible. In at least one embodiment, the cover is generally comprised of a water resistant or water repellant material, allowing the cover 60 to serve as a rain cover. For example, the cover may be comprised of a polymer material, water resistant fabric, or a "durable water repellent" fabric that at least conforms to the AATCC-22 "meeting or exceeding 80 point rating after 20 washes" standard for water repellency (spray method) as published by the American Association of Textile Chemists and Colorists (AATCC). Additionally, in at least one embodiment, the cover 60 is comprised of a material with sufficient strength to resist cutting with a blade, thus providing a theft deterrent feature to the cover. For example, the cover may be comprised of a fabric made of ultra-high-molecular-weight polyethylene and other fibers, or any other cut resistant fabric known to those of skill in the art.

Figure 6:
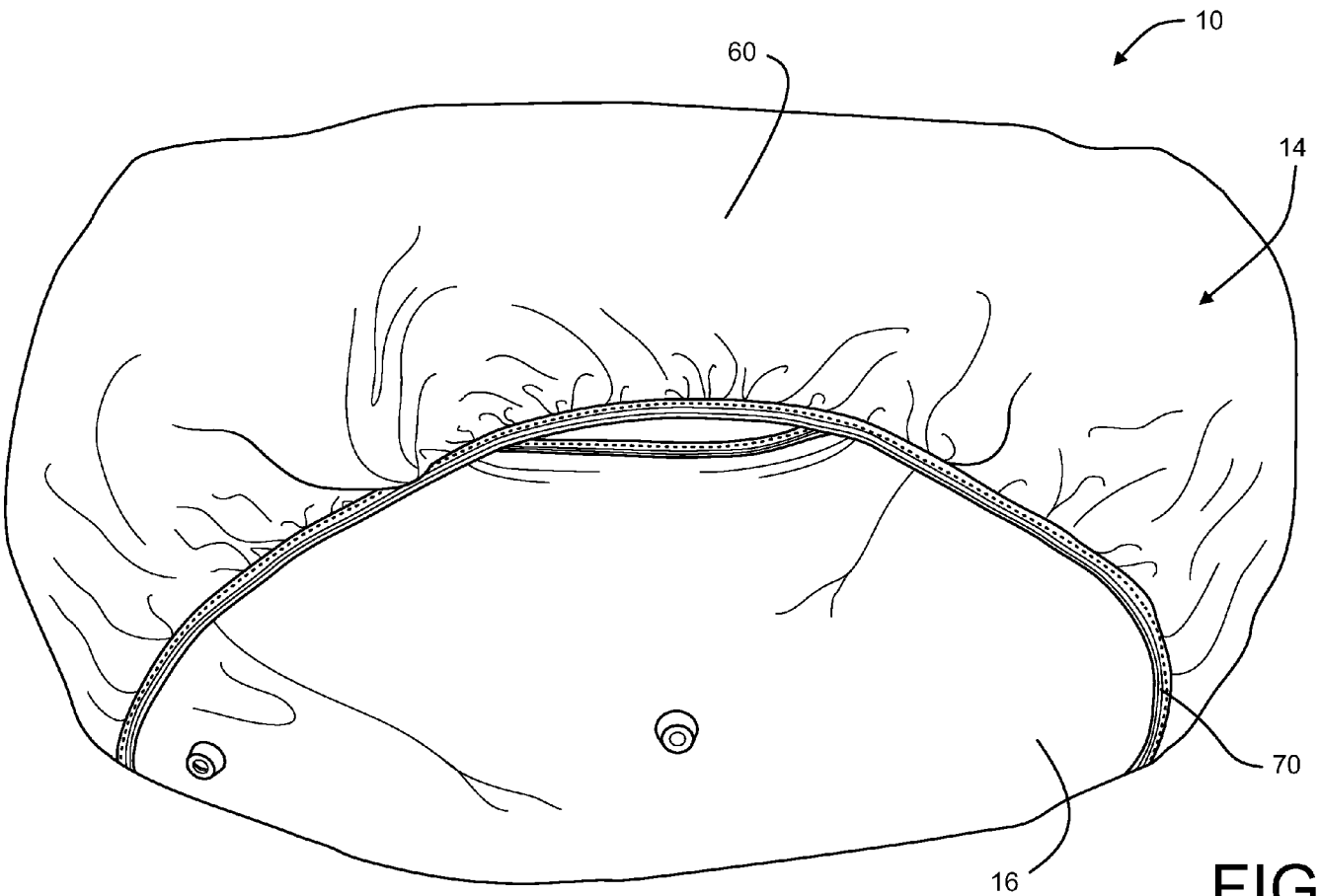
FIG. 6 shows a bottom perspective view of the bag of FIG. 1 with the cover in a protective position covering the body portion of the bag.

The cover 60 defines a perimeter portion 62, a middle section 64, a first end 66 and a second end 68. The cover 60 also includes an elastic member 70 which is attached along the perimeter portion 62. The cover 60 is designed and dimensioned to extend over the outer shell 20 of the bag 10 to shield the bag 10, for example, from inclement weather. As shown in FIG. 6, the cover 60 may extend over and surround the upper portion 14 of the bag 10, without wrapping around the base portion 16. The elastic member 70 of the cover 60 is configured to contract around the base portion 16 of the bag 10 so that liquid may be kept from reaching the upper portion 14 of the bag 10. In another embodiment, the cover 60 may surround the entire bag 10, including both the upper portion 14 and the base portion 16. In this embodiment, the elastic member 70 may be replaced by an overlapping fabric and may include no closure, a zipper closure, a hook and loop closure, a button closure or any other suitable means for enabling the cover 60 to shield the entire bag 10.

The cover 60 is non-removably attached to the pocket 50. In particular, as shown in FIG. 5, at least one edge 61 of the cover 60 is fixedly connected to the inside of the pocket 50. For example, the edge 61 may be sewn or permanently adhered to the inside of the pocket 50. This configuration enables the cover 60 to be permanently associated with the bag 10, preventing the cover 60 from being lost. However, in at least one alternative embodiment, the cover 60 may not be attached to the bag, and may be free from the pocket 50. In either case, as explained in further detail below, when not in use, the cover 60 may be stored within the pocket 50. The cover 60 may then be quickly and easily withdrawn from the pocket 50 and placed over the bag 10 when needed.

As shown in FIG. 4, the cover 60 may be collapsed into a collapsed position. When in the collapsed position, the cover 60 may be completely contained within the pocket 50. The collapsed position is useful for situations in which the upper portion 14 of the outer shell 20 does not need to be shielded by the cover 60. Alternatively, as shown in FIGS. 5 and 6, the cover 60 may be removed from the pocket 50 (see FIG. 5) and spread out into a protective position (see FIG. 6). When in the protective position, the cover 60 may surround the upper portion 14 of the body portion 18 of the bag 10. The protective position is useful for situations in which the outer shell 20 needs to be shielded by the cover 60. In addition, the protective position may help deter theft as the cover 60 would provide an obstacle to accessing items stored within the bag 10.

Figure 7:
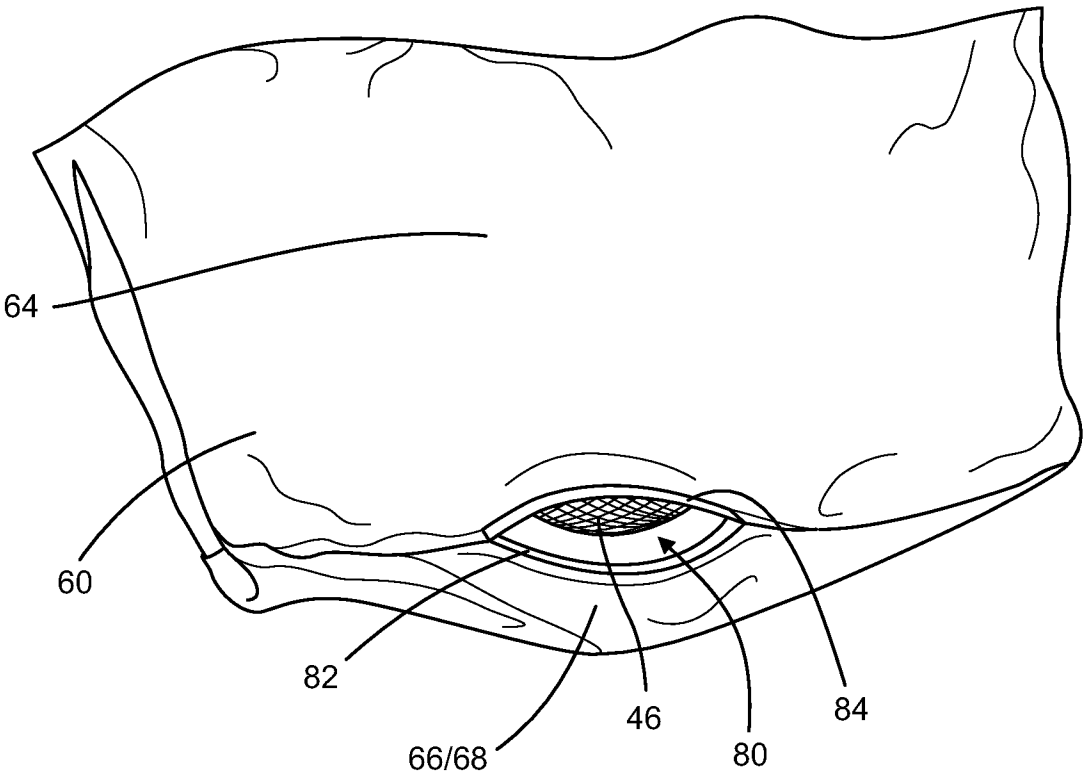
FIG. 7 shows a top view of an opening in the cover of FIG. 6.

Referring now to FIG. 7, the cover 60 includes at least one opening 80. The opening 80 may include an outer flap 82 and an inner flap 84. In the disclosed embodiment, the opening 80 is formed where the middle section 64 overlaps either the first end 66 or the second end 68. The outer flap 82 is created by a portion of the first end 66 or second end 68 that overlaps with a portion of the middle section 64. The inner flap 84 is created by a portion of the middle section 64 that overlaps with a portion of the first end 66 or second end 68.

Figure 8:
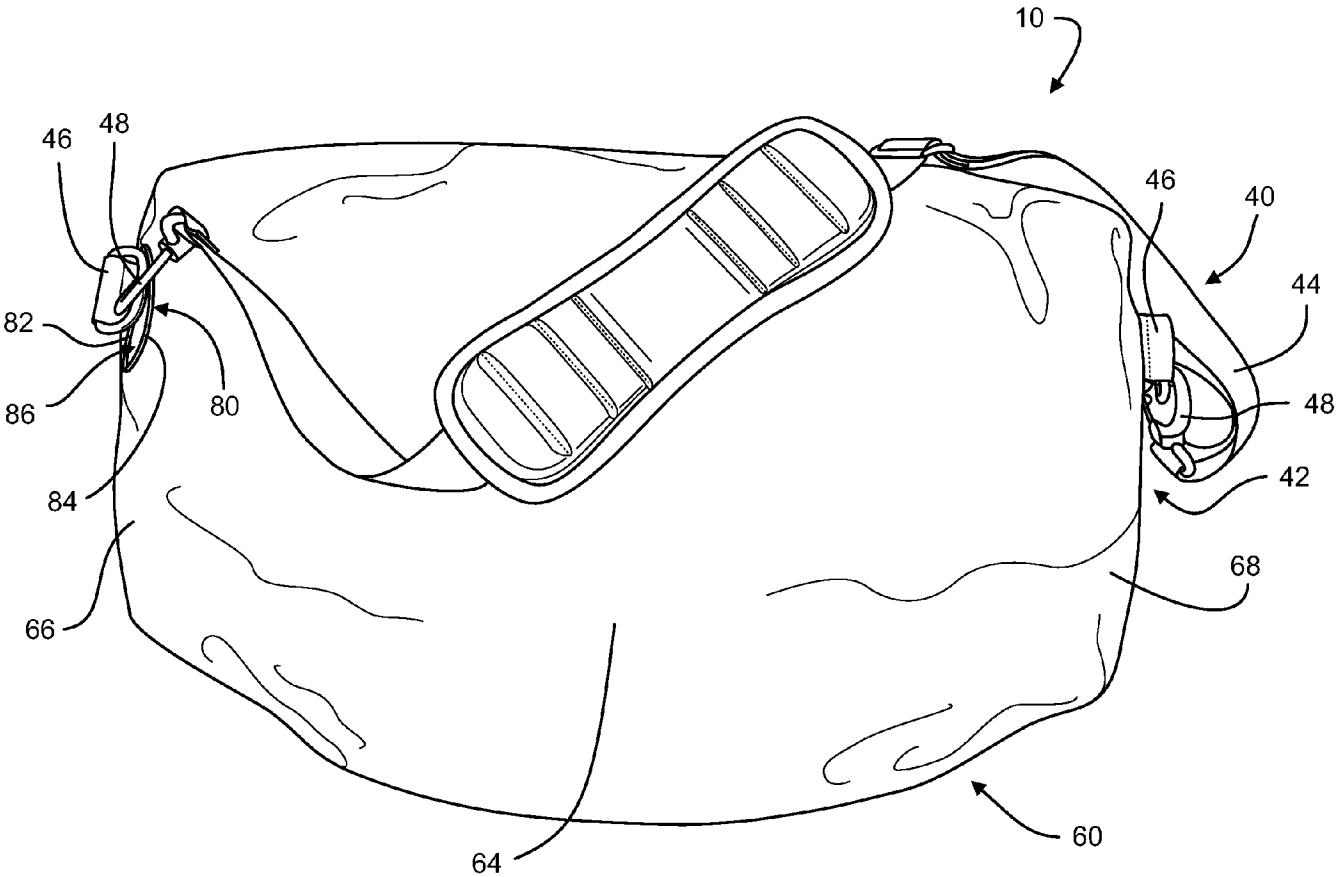
FIG. 8 shows a top perspective view of the bag of FIG. 1 with the cover in a protective position covering the body portion of the bag with a strap coupling extending through the opening in the cover and the strap attached to the strap opening.

As shown in FIG. 8, the opening 80 is provided in the cover 60 to enable the coupling member 42 to pass from the inside of the cover 60 to the outside of the cover 60. Accordingly, a user may remove the flexible strap 44 from the bag 10, cover the bag 10 with the cover 60, insert the coupling member 42 through the opening 80, and then re-attach the flexible strap 44 to the bag. This allows the user to more easily carry the bag 10 when the cover 60 surrounds the bag.

When the coupling member 42 passes through the opening 80, the outer flap 82 and the inner flap 84 surround the coupling member 42 leaving a very small gap 86. Thus, very little of the outer shell 20 (not visible in FIG. 8) of the bag 10 is exposed when the flexible strap 44 of the carrying arrangement 40 is releaseably attached to the coupling member 42 of the bag 10 while the cover 60 is in the protective position. In the disclosed embodiment, the opening 80 includes overlapping flaps 82 and 84, but no closure. In alternative embodiments, the opening 80 may include a zipper closure, a hook and loop closure, a button closure or any other appropriate closure to enable the carrying member to pass through the cover 60 and be releasably attached to the bag 10 while the cover 60 is in the protective position.

In the disclosed embodiment, the cover 60 includes two openings 80, one located at the boundary of the middle section 64 and the first end 66 and one located at the boundary of the middle section 64 and the second end 68. This configuration allows coupling members 42 at opposing ends of the bag 10 to pass through the openings 80 when the cover is stretched over the bag 10. Thereafter, the carrying member 41, such as the flexible strap 44 may be removably attached to the coupling member 42 of the bag 10. In particular, the loops 46 of the coupling members 42 may be inserted through the openings 80, and then the hooks 48 on the ends of the flexible strap 44 may be joined to the loops 46 in order to secure the flexible strap 44 to the bag 10 while the cover 60 is in a protective position.

Although one embodiment of the bag 10 has been shown in FIGS. 1-8, it will be recognized that numerous alternative embodiments are possible. For example, in one alternative embodiment, openings 80 may be located at other positions on the cover 60 in addition to or in lieu of the openings 80 at the ends of the cover 60. For example, at least one opening 80 may be located within the middle section 64. This configuration would allow a carrying member 41 in the form of a handle in the center of the bag 10 to pass through the cover 60 when the cover 60 is in a protective position. In such embodiment, the handle may be removably attached to the bag 10 with one or more coupling members 42, and one or more small openings may be provided in the cover 60 to pass the one or more coupling members 42. Alternatively, the handle may be non-removably attached to the outer shell 20, and the opening may be sufficiently large to pass the entire handle.

In an alternative embodiment, the bag 10 includes a hanging member (not shown) connected to the outer shell 20 of the bag 10. The hanging member is configured to enable hanging the bag 10 on a complimentary hook, for example, in a locker or on a fence. This feature could further prevent liquid from entering the bag 10 by keeping the bag 10 off the ground and out of potential puddles. The cover 60 includes an opening 80 configured to pass the hanging member to enable hanging the bag 10 by the hanging member when the cover 60 is in the protective position. The opening 80 may include no closure, a zipper closure, a hook and loop closure, a button closure or any other appropriate closure to enable hanging the bag 10 by the hanging member when the cover 60 is in the protective position.

As shown in FIG. 1, the bag 10 may include a side pocket 100 on the first side 22 and access to that side pocket 100 through an access opening 104. In the disclosed embodiment, the access opening 104 consists of two overlapping sections of material configured to enable the top section 106 to be on the outermost portion of the bag 10 and lay over the bottom section 108. This configuration enables the top section 106 and the bottom section 108 to overlap and prevents the access opening 104 to the side pocket 100 from opening unintentionally. This configuration does not require a closure. In an alternative embodiment, the access opening 104 may include a zipper closure, a hook and loop closure, a button closure or any other appropriate closure to prevent the access opening 104 to the side pocket 100 from opening unintentionally.

In at least one alternative embodiment, the cover 60 includes an access passage (not shown). The access passage may be located in a position on the cover 60 to correspond with the position of the access opening 104 on the side pocket 100 on the first side 22 of the bag 10. Such a location would enable access to the side pocket 100 through the access passage on the cover 60 and the access opening 104 while the cover 60 is in a protective position. Alternatively, the access passage may be located in another position on the cover 60 to allow access to other portions of the bag 10 while the cover 60 is in a protective position.

The access passage may consist of two overlapping sections of material configured to enable the top section to be on the outermost portion of the cover 60 and lay over the bottom section. This configuration enables the top section and the bottom section to overlap and prevents the access passage from opening unintentionally. This configuration does not require a closure. In another alternative embodiment, the access passage may include a zipper closure, a hook and loop closure, a button closure or any other appropriate closure to prevent the access passage from opening unintentionally.

In operation, the cover 60 disclosed above may be used to protect the bag 10 and its contents from damage, for example, in the event of inclement weather or to prevent theft. In such a case, the user removes the flexible cover 60 from the pocket 50 of the bag 10 and stretches the flexible cover 60 into a protective position over the outer shell 20 of the bag 10. The user then inserts the coupling member 42 through an opening 80 in the flexible cover 60, exposing the coupling member 42 to the exterior of the flexible cover 60. The user then connects a carrying member 41 such as a shoulder strap to the coupling member 42. Accordingly, when the cover 60 is withdrawn from the pocket 50 and is used to protect the bag 10, openings 80 in the cover 60 enable continued utilization of the carrying member 41. This allows the cover 60 to protect the bag 10 and its contents but simultaneously allows the bag 10 to be functional as it can still be carried and used. Following transport and use of the cover 60, the user removes the carrying member 41 from the coupling member 42, allowing the flexible cover 60 to be removed from the outer shell 20 of the bag 10. The user may then return the flexible cover 60 to the pocket 50 for storage.

The foregoing detailed description of one or more embodiments of the bag with a cover has been presented herein by way of example only and not limitation. It will be recognized that there are advantages to certain individual features and functions described herein. Moreover, it will be recognized that various alternatives, modifications, variations or improvements of the above-disclosed embodiments and other features and functions, or alternatives thereof, may be desirably combined into many other different embodiments, systems or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. A bag comprising:

a body portion with a storage compartment provided within the body portion;

a carrying arrangement including a carrying member and a coupling member, the coupling member configured to attach the carrying member to the body portion;

a pocket carried by the body portion, the pocket defined by a free edge that is loosely retained within the body portion; and a cover positioned within the pocket, the cover designed and dimensioned to cover the body portion, the cover including an opening configured to pass the carrying arrangement from the body portion to a position outside of the cover, the opening defined between an outer flap on the cover that overlaps an inner flap on the cover.

2. The bag of claim 1 wherein the cover is comprised of a water resistant material.

3. The bag of claim 1 wherein the carrying member is a shoulder strap.

4. The bag of claim 1 wherein the carrying member is a handle.

5. The bag of claim 1 wherein the opening includes a first opening spaced apart from a second opening on the cover.

6. The bag of claim 1 wherein the opening is arranged and configured on the cover to pass the coupling member through the opening when the cover is placed over the bag.

7. The bag of claim 1 wherein the cover includes an elastic member along a perimeter portion of the cover.

8. The bag of claim 1 wherein the body portion is comprised of a flexible material, wherein the outer shell includes a storage compartment closure that extends from a first side to a second side of the body portion, and wherein the pocket is provided within the storage compartment.

9. The bag of claim 1 wherein the carrying member is releaseably coupled to the coupling member.

10. The bag of claim 1 wherein the body portion includes an upper portion and a base portion and wherein the cover is configured to substantially cover the entire upper portion.

11. The bag of claim 1 wherein the cover includes a middle section coupled to an end section and the outer flap is formed by a length of the end section that is de-coupled from but overlaps a length of the middle section.

12. The bag of claim 1 wherein a closure is associated with the opening.

13. A bag comprising:

an outer shell with a storage compartment provided within the outer shell;

a cover carried within the outer shell with at least one opening provided in the cover, the at least one opening defined between an outer flap on the cover that overlaps an inner flap on the cover, the cover further including a middle section coupled to an end section and the outer flap formed by a length of the end section that is de-coupled from but overlaps a length of the middle section, the cover configured to be arranged in both a collapsed position where the cover is situated within the outer shell and a protective position where the cover substantially surrounds the outer shell;

a strap coupling connected to the outer shell and configured to extend through the at least one opening in the cover; and a strap releaseably coupled to the strap coupling.

14. The bag of claim 13 wherein the strap is a shoulder strap.

15. The bag of claim 14 wherein the strap is a handle.

16. The bag of claim 13 further comprising a pocket positioned within the outer shell, wherein the pocket is configured to retain the cover when the cover is in the collapsed position.

17. The bag of claim 16 wherein the cover is non-releaseably connected to the pocket.

18. The bag of claim 16 wherein the pocket is defined by a free edge that is loosely retained within the storage compartment.

19. The bag of claim 18 wherein the free edge includes three sides of the pocket, and a fourth edge of the pocket is secured within the storage compartment.

20. The bag of claim 13 wherein the cover is comprised of a water-resistant or water-repellant material.

* * * * *